US006402670B1

(12) United States Patent
Anagnostou

(10) Patent No.: US 6,402,670 B1
(45) Date of Patent: Jun. 11, 2002

(54) LINE AND POLE, TRAVEL SIZE FITNESS DEVICE, FOR UPPER AND LOWER BODY WEIGHTLIFTING TYPE PHYSICAL EXERCISES, UTILIZING A HUMAN'S OWN BODYWEIGHT

(76) Inventor: Thomas Anagnostou, 32 Cheswold Blvd., Apt. 1B, Newark, DE (US) 19713

( * ) Notice: Subject to any disclaimer, the term of this patent is extended or adjusted under 35 U.S.C. 154(b) by 0 days.

(21) Appl. No.: 09/664,567

(22) Filed: Sep. 18, 2000

(51) Int. Cl.[7] ..... A63B 69/18; A63B 71/00; A63B 22/00

(52) U.S. Cl. ..... 482/148; 482/70; 482/71; 482/148

(58) Field of Search ..... 482/70, 71, 72, 482/75, 126, 91, 95, 96, 77, 78, 79, 80, 116, 118, 123, 141, 143, 131, 907, 129, 145, 148; 602/32–40

(56) References Cited

U.S. PATENT DOCUMENTS 1,078,962 A * 11/1913 Schmid
1,190,421 A * 4/1916 Kaley
1,452,733 A * 4/1923 Garlock
2,646,282 A * 7/1953 Ringman
2,772,881 A * 12/1956 Fundom
2,783,997 A * 3/1957 Gaffney et al.
3,065,962 A * 11/1962 Hoffmeister
4,664,373 A 5/1987 Hait
4,756,524 A 7/1988 Cooney
5,029,847 A 7/1991 Ross
5,778,914 A 7/1998 Trani
5,788,608 A 8/1998 Wilkinson
5,944,640 A 8/1999 Larsson
5,967,955 A 10/1999 Westfall et al.
6,024,677 A 2/2000 Siwertz
6,086,521 A 7/2000 Solland

* cited by examiner

*Primary Examiner*—Michael A. Brown
*Assistant Examiner*—Lori Baker Amerson

(57) ABSTRACT

A travel-size exercise device used in pairs to induce muscle-building effect on both upper and lower body comprising an elongated length-reducible rigid member (100) attached to an elongated flexible foot traction member (106). A set of holding provisions comprise a primary handle (44) forming a T-connection due-top on rigid member (100), and an auxiliary handle (54) forming a perpendicular protrusion midwards on member (100). A set of limb-fastening provisions comprise an ankle strap (110) mounted at right angles upwards on rigid member (100), and a corresponding knee support (112) layered upon auxiliary handle (54). Rigid member.(110) has a bottom end engaged to a revolving shoe (62) removably capped with a friction-tip (64) for stable ground engagement. A traction member (106) has one end comprising a spring clasp (72) attached to shoe (62) of rigid member (100), and an intermediate section comprising a foot strap (76) followed by an array of bumps (78) equidistantly spaced thereafter towards the other end. An operator selectably interfaces with the device, so that enough ground reaction force is transferred through a pair of rigid members (100) to oppose body-weight displacement induced by repetitive motion of the operator's arms or legs.

6 Claims, 14 Drawing Sheets

LINE AND POLE, TRAVEL SIZE FITNESS DEVICE, FOR UPPER AND LOWER BODY WEIGHTLIFTING TYPE PHYSICAL EXERCISES, UTILIZING A HUMAN'S OWN BODYWEIGHT

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX Not applicable

BACKGROUND

1. Field of the Invention

This invention relates to weight resistance exercise devices, specifically to those devices that provide full body training, as well as those that are portable and compact enough to be suitable for travel.

2. Description of Prior Art

The observable effect of muscular performance is motion, and evidently it constitutes the key element of exercise. Hence, any ability to sustain motion to the effect of displacing either external objects, or ones' own body, would indicate the level of a person's fitness.

Athletes of every kind have begun to realize the importance, effectiveness, and benefits of resistance training, specifically weightlifting, towards improving their performance. The popularity of weightlifting is reasonably expected due to the fact that it feels more natural, compared to other forms of resistance training, such as those involving elastic mediums. An explanation of such preference may be as simple as the fact that, human nature has evolved throughout the millennia developing muscles to the effect of moving, lifting, pushing, and manipulating objects against gravity.

A variety of exercise devices has emerged over the years, to facilitate an ever-growing number of health and performance conscious people. Simple devices, such as a barbell or a dumbbell, and machines that isolate specific muscles at a time, have become the staple tools of a weight training facility.

However, these facilities require numerous equipment that take space, amount to a lot of weight, and they represent a good deal of monetary investment. The serious athlete faces the limitation of having to pay tuition to such facilities in order to achieve a comprehensive workout. Furthermore, the athlete needs to make frequent visits for a regular workout routine, which is most probably on a daily basis.

An attempt to relieve the inconvenience of commuting to a health club so frequently is evident by several weight-training equipment that have been developed for home use. This type of equipment is designed to combine the functions of several muscle-isolation machines into a compact unit. However, home training centers are still costly, have a significant weight and their transportation would require special effort along with assembly and disassembly of several parts.

A number of handheld devices have become available over the years, attempting to remedy the issue of portability.

These devices depart from the use of gravity and they explore other forms of resistance such as elastic, viscous or frictional media. However, non-gravity media does not feel natural to the human body. Therefore, such equipment are suited for low intensity workout routines, which are intended for muscle toning instead of muscle building effect. Furthermore, by virtue of simplicity, there is compromise in function. These devices are often limited, specializing to only certain muscle groups, while failing to provide training for other parts of the body. There is no bodybuilder, to the knowledge of this author, who has developed a competition level physique purely by stretching a rubber band type exerciser or compressing a spring loaded apparatus.

An intermediate solution that combines portability without departing from the gravity type notion of resistance has been explored as well. Devices of this type are using a person's own body weight as a resistance medium. However, such equipment retain a plurality of moving parts and linkages due to their geometry, and although portable are not suited to carry-on.

For example, U.S. Pat. No. 06,024,677 offers enough functionality to exercise both upper and lower body muscles. However, there is a plurality of moving components, a fairly involved construction and an overall size that make this device not suitable for traveling standards. U.S. Pat. No. 06,086,521 offers a more simplistic design, but it is not versatile enough to offer a comprehensive full body workout for a dedicated athlete. Furthermore, this design is still not compact enough to be considered a handheld device that fits within a travel bag.

Generally, when it comes to exercise equipment, the level of portability is inversely proportional to the level of effective weight training potential. Extremely portable devices have limited potential, while those that have extensive weight training potential are not portable. There are also variations in-between the two extremes, but the mere fact of having to compromise makes them fall into the mediocre range.

In summary, there is a number of disadvantages which can be distinguished in the existing exercise devices towards weight resistance training.

a) The simplest, lightest forms of existing portable devices are not versatile enough to be of practical use for muscle building, full body training.

b) Conversely, the more effective devices are not simple or portable enough to be considered for frequent relocation, or simply, traveling convenience.

c) Therefore, existing devices pose limitations so that the option of comprehensive weight-resistance training cannot be offered in a practical way to people who are always on the road.

d) A number of existing devices require the presence of a wall, or a doorframe, or other type of external morphology, in order to function properly. An example of such a device is U.S. Pat. No. 05,944,640.

e) Many exercise devices offer a type of resistance, which is other than gravity or its derivatives. These devices may appeal to some people, but would not feel as intuitive to many who would prefer a weight-resistance type of training.

f) Existing portable exercise equipment cannot accurately replicate the free-weight experience. Free-weights help develop physical intuition by forcing the individual to maintain proper form during exercise. This is accomplished by consciously making adjustments aiming the free-weight to the proper motion path. For example, lifting a barbell in a bench press requires special concentration to keep it straight and prevent it from veering to the sides.

g) All exercise devices, brought to the attention of this author, require manual adjustment of the resistance level. In other words, the operator needs to stop and make adjustments on the device to effect the difficulty of the intended exercise.

SUMMARY

The proposed device is an exerciser consisting of a pair of poles with a traction line attached at the lower end of each pole.

The exerciser can be used towards the effect of weight-resistance training, utilizing gravity in a similar way to that of a common push-ups exercise. The operator induces fatigue on a selected muscle by interfacing with the exerciser, in such a way, that any movement of the targeted muscle displaces the operator's own bodyweight.

The body of each pole features two cushioned handles, one at the top and another one slightly above the middle point. A strap equipped with end buckles is mounted below the top handle of each pole. The function of each strap is to secure the ankles of the operator during a leg curl exercise.

The traction lines provide sufficient foot support during normal use. Each line is a rope folded in half with three equidistant bumps located at the free end. Each bump is a double-rope knot causing the line to form loops in-between such knots. At the middle of each traction line, a strap is attached to form a loop used primarily in a leg extension exercise.

Each pole is designed to separate in half and each line can be folded, thus reducing the overall size of the device, to fit into a bag with similar dimensions to that of a tennis racket. Furthermore, the choice of materials for this exerciser should be so lightweight (but strong) so that the device is considered practically weightless.

OBJECTS AND ADVANTAGES

A person's own weight can be a formidable force of resistance, as for example, in a gymnastic "Maltese" or "Iron cross" stunt on the Still-rings at the Olympic games. Therefore, the proposed device is introduced on the following intentions.

a) To provide a single device versatile enough to offer weight resistance exercises for both upper and lower body muscles.

b) To provide a weight-resistance-training device, which is lightweight and compact enough, that someone would be able to simply pick up, as if it was a tennis racket or a base-ball bat, and go outdoors to workout.

c) To offer a weight training option to people whose profession, or circumstances, force them to be away from home most of the time. As for example, a sea merchant, a truck driver, a soldier, an archeologist doing studies in the field, a business traveler, a camper, people on vacation, and people who do not feel they have to perform their daily workout routine at the same location.

d) To provide an exercise device which is self-standing without needing to be mounted anywhere or require a specific environmental support such as a wall, a doorframe, a step, or a corner, in order to function properly.

e) To preserve the notion of weight-resistance, which feels more natural, inviting, and intuitive, compared to devices that make use of elastic or other alternative mediums.

f) To offer an exercise device that helps improve muscular awareness, concentration, and control. Specifically, the user will be compelled to mentally concentrate and consciously perform minor adjustments of posture in a way to isolate the muscle intended to be trained at that time. This is a way to develop awareness of ones own body, the location of particular muscles and their intended function.

g) To provide a simple exercise device whose resistance can be dynamically varied during exercise. This can be accomplished by minor adjustments of posture, shifting the operator's center of gravity in order to impose a larger (or smaller component of his/her bodyweight against the working muscles.

There is one more factor, worthy of consideration, which is namely the social motivation element. Many people choose to workout in designated facilities, because it is much harder to maintain discipline in a private environment. Somehow the social and emotional part of a workout experience is often more important than the physical equipment alone. For that purpose, the proposed exercise device is not limited to be used in isolation, but on the contrary, it can be an enhancement to the existing arsenal of equipment for a commercial weightlifting facility. In this context, the proposed exercise device can offer an intensity of workout, which is at a par with existing commercial machines. Furthermore, it offers the option of approaching muscles from unique angles combined with freedom of motion that requires minor muscles for balancing and control. This is a beneficial feature since most dedicated bodybuilders already prefer to use a variety of equipment. The intention is to 'hit' a body-part from as many angles of motion as possible, attempting to reach and develop minor muscles that cannot be easily trained otherwise.

DRAWING FIGURES

Overview

All drawing figures are numbered from 1 through 31B. Individual parts receive numbers from 40 through 99, while assemblies of several parts are assigned three digit numbers from 100 through 112.

REFERENCE NUMERALS IN DRAWINGS

| | | | |
|---|---|---|---|
| 40A | padding | 40B | pad-retainer plate |
| 40C | hole | 42 | screw |
| 44 | primary handle | 44A | primary handle |
| 46A | female buckle | 46B | webbing |
| 46C | intermediate buckle | 46D | male buckle |
| 48 | strap-retainer | 50 | screw-adjustable clamp |
| 52 | main beam | 54 | auxiliary handle |
| 54A | auxiliary handle | 54B | flat surface |
| 54C | end face | 56A | padding |
| 56B | pad-retainer plate | 56C | hole |
| 57 | threaded opening | 58 | washer |
| 60A | threaded end | 60 | extension beam |
| 60B | toe | 60C | threaded opening |
| 62 | revolving shoe | 62B | eyelet |
| 62C | trapezoidal lip | 64 | friction-tip |
| 66 | bolt | 68 | sleeve |
| 70 | washer | 72 | spring-clasp |
| 74 | rope-clamps | 76 | foot-strap |
| 78 | bump | 79 | loop |
| 80 | rope | 80A | folding end |

-continued

| | | | |
|---|---|---|---|
| 80B | free end | 81 | operator |
| 82 | lock mechanism | 84 | telescoping tube |
| 86 | primary handie | 88 | convenience opening |
| 90 | knee surface | 92 | pin linkage |
| 93 | retractable belt | 94 | bump |
| 96 | foot-strap | 98 | retractable belt cartridge |
| 99 | pivoting belt slot | 99A | pivoting belt slot |

Assemblies

The term 'assembly' is used to imply a collection of parts. The term 'subassembly' is used to imply a collection of parts that are a pure subset of a larger collection. Assemblies and subassemblies are indicated in the drawings with the use of arrowheads accompanied with a reference numeral.

100 rigid-member assembly (parts 40 through 70)

102 trunk subassembly (parts 40 through 56)

104 leg subassembly (parts 58 through 70)

106 traction-member assembly (parts 72 through 80

108 primary-cushion subassembly (parts 40A and 40B)

110 ankle-strap subassembly (parts 46A, 46B, 46C, 46D)

112 knee-support subassembly (parts 56A and 56B)

LIST OF FIGURES

Figures Intended to Show an Overview of the Invention

FIG. 1 shows the exerciser in its complete assembled form

FIG. 2 presents a rear view snapshot with the rigid-member separated from the traction-member of the exerciser FIG. 3 illustrates the two major components of the rigid-member detached from each other FIG. 4 is a cross sectional view, as indicated by section lines 4—4 of FIG. 3

FIG. 5 is a cross sectional view of a fully assembled revolving shoe, as indicated by section lines 5—5 of FIG. 3

Figures Intended to Show Detail

Figure 12:
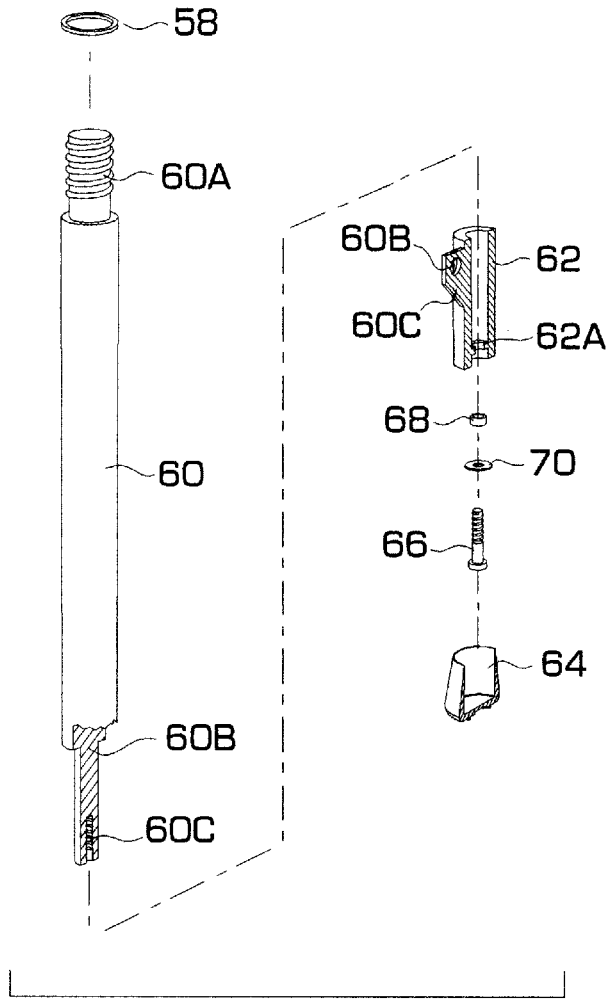
Figure 13:
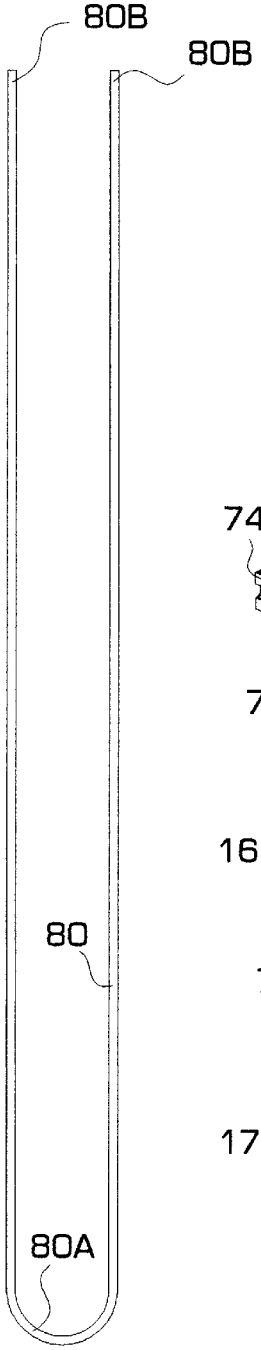
Figure 14:
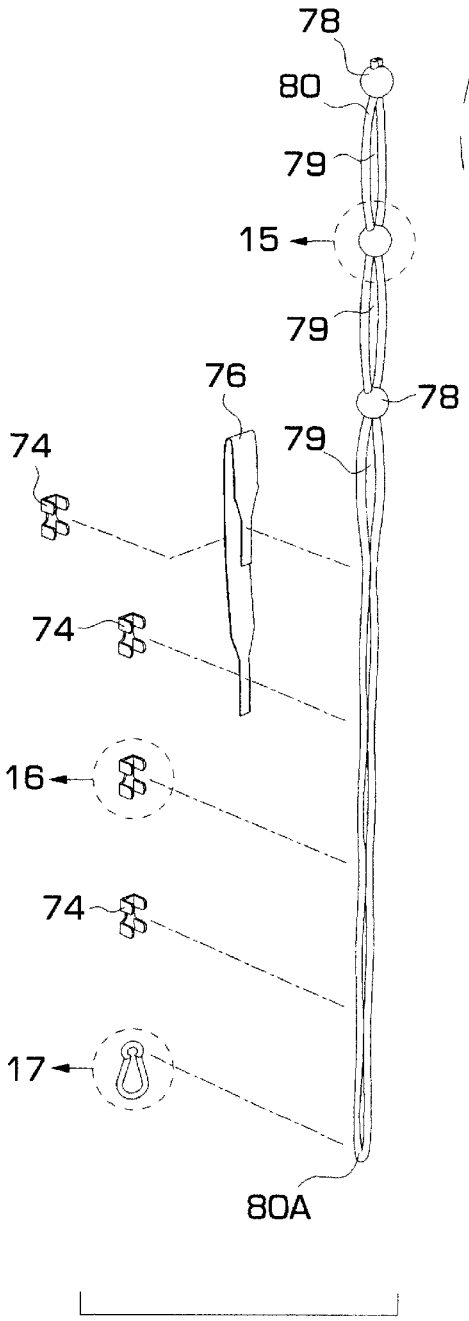
Figure 15:
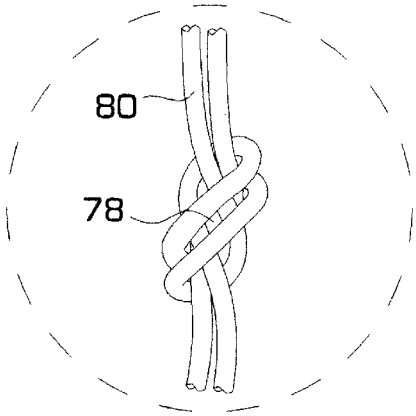
Figure 16:
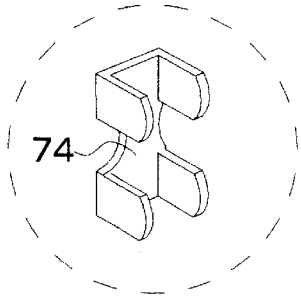
Figure 17:
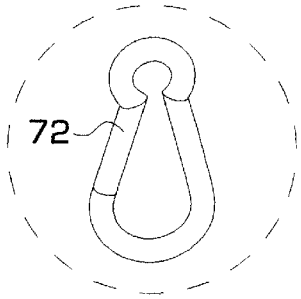
Figure 18A:
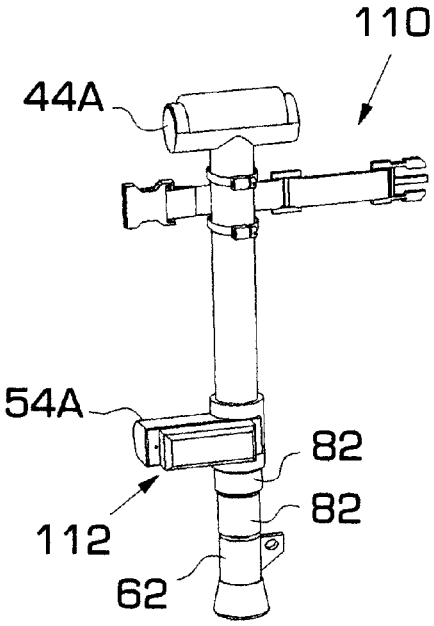
Figure 18B:
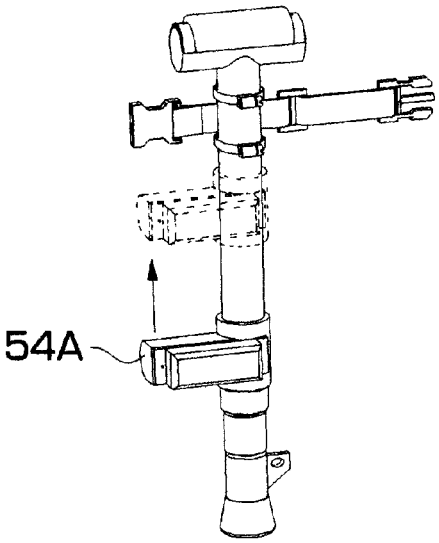
Figure 19A:
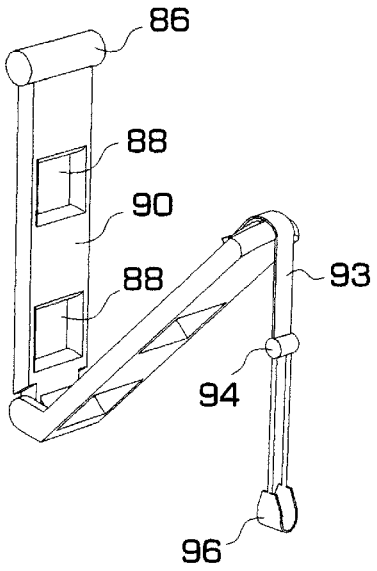

FIG. 12 is an exploded view of the leg, or lower section of the rigid member FIG. 13 illustrates a single length of rope folded in half intended to form the basic ingredient of the traction member FIG. 14 is an exploded view showing the assembly components of the traction-member FIG. 15 is a magnified view of a double-rope knot FIG. 16 is a magnified view of a rope clamp FIG. 17 is a magnified view of a connecting clasp Figures Illustrating Alternative Embodiments FIG. 18A is a telescoping tube design fully reduced to its minimum length FIG. 18B is a telescoping tube design in its fully extended state FIG. 19A a folding design shown in its semi-folded position, exhibiting multiple auxiliary handles (or convenience openings and a retractable belt.

Figure 19B:
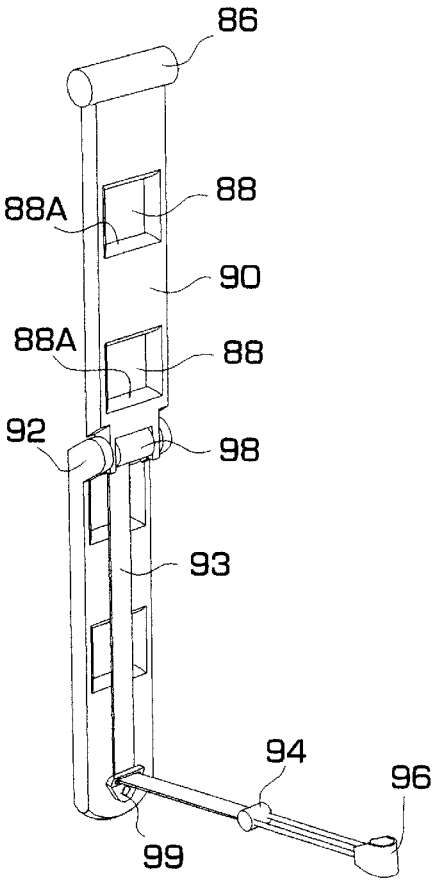

FIG. 19B shows a folding design with its two members fully unfolded

Figure 19C:
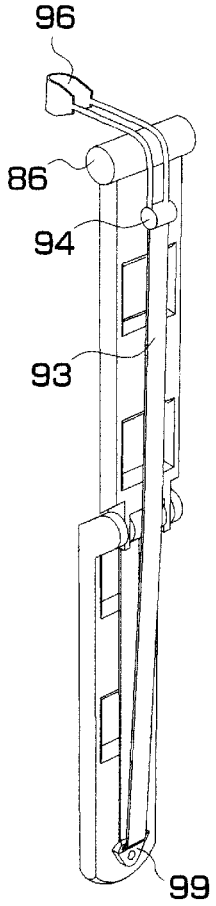
Figure 19D:
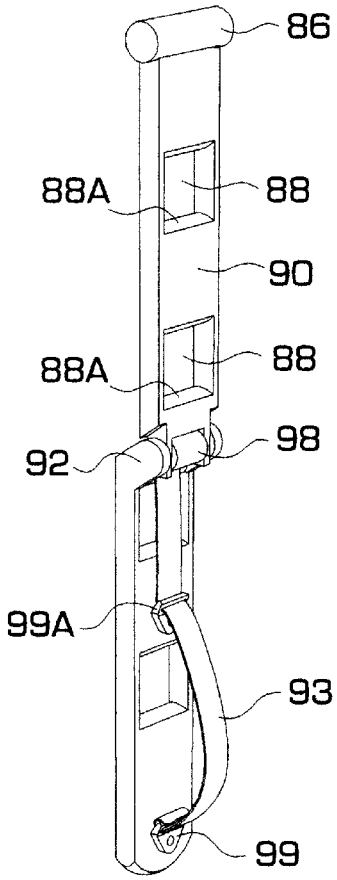
Figure 19E:
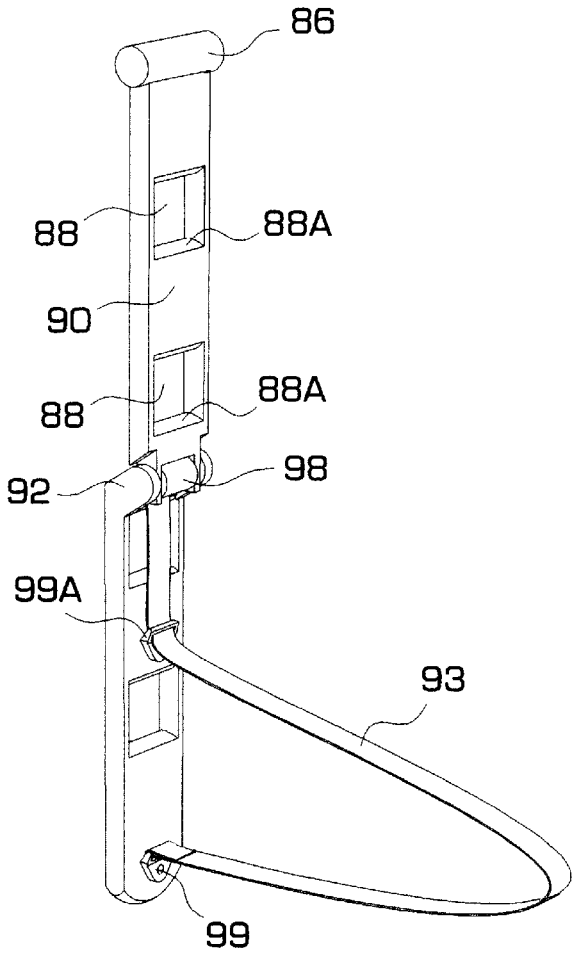

FIG. 19C the same folding design but with its retractable belt extended in such a way so that its foot-strap bends around the top of the exerciser FIG. 19D the folding design with an alternative retractable belt arrangement, engaged at two points FIG. 19E the same arrangement as in FIG. 19D, but the retractable belt is extended to form a larger loop.

Figures Illustrating the Operation of the Invention

Each figure from FIG. 20 to FIG. 31 has an attached letter suffix A or B indicating, respectively, the initial and final stages of the same exercise.

Figure 20A:
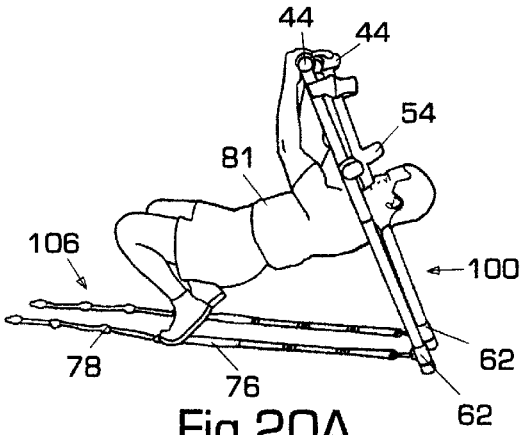
Figure 20B:
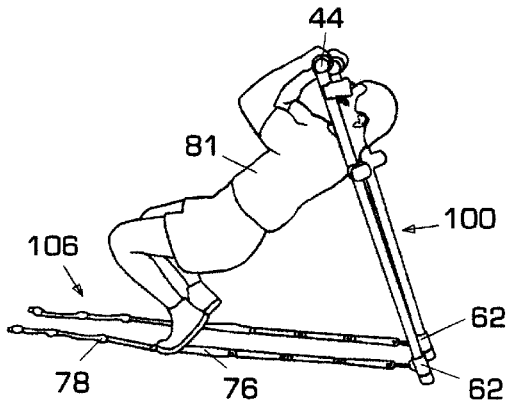
Figure 21A:
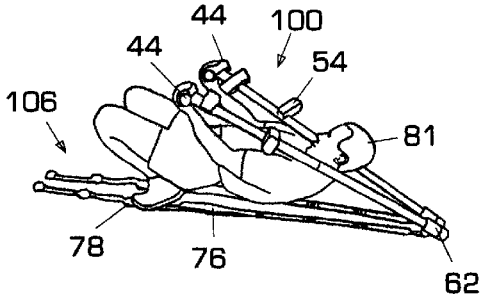
Figure 21B:
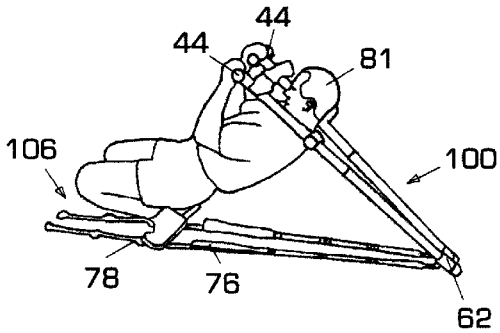
Figure 22A:
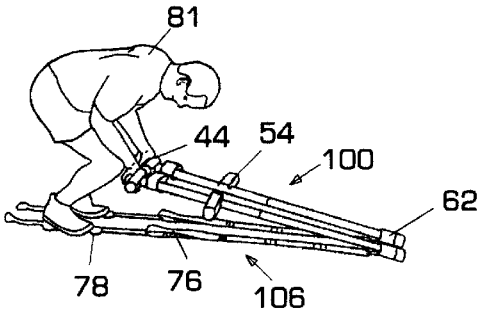
Figure 22B:
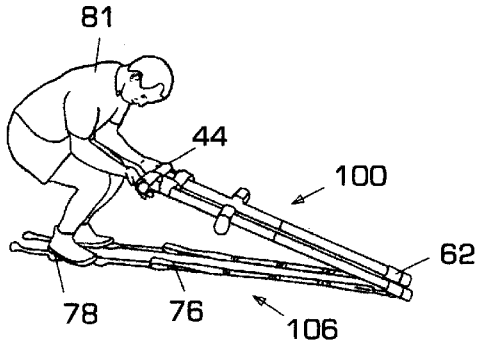
Figure 23A:
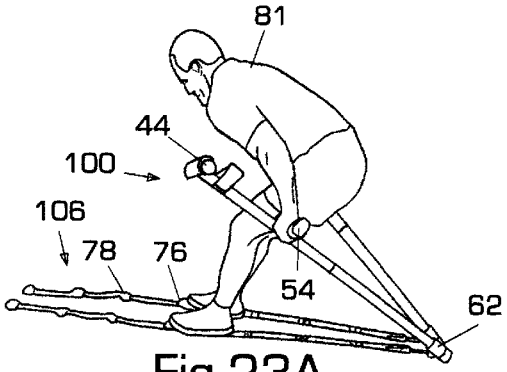
Figure 23B:
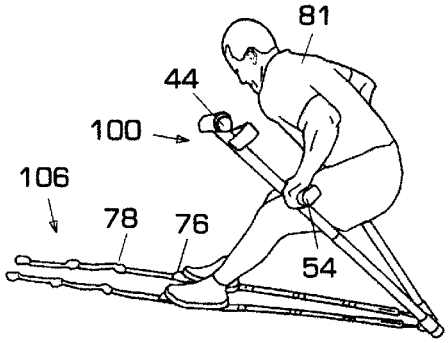
Figure 24A:
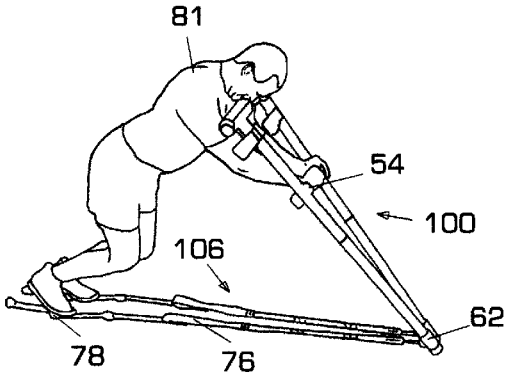
Figure 24B:
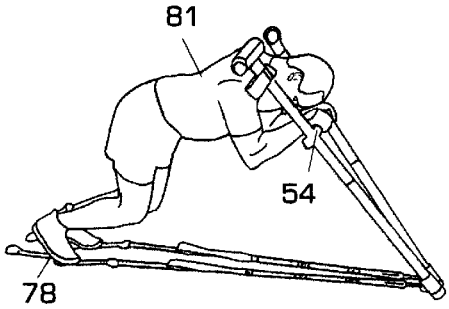
Figure 25A:
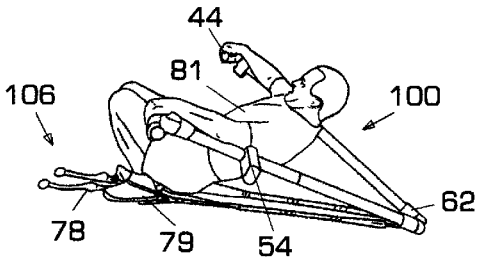
Figure 25B:
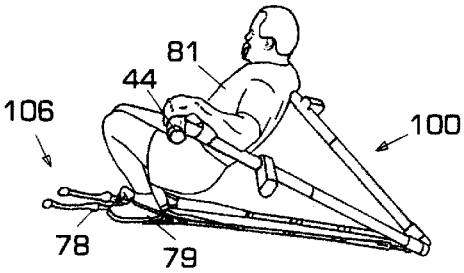
Figure 26A:
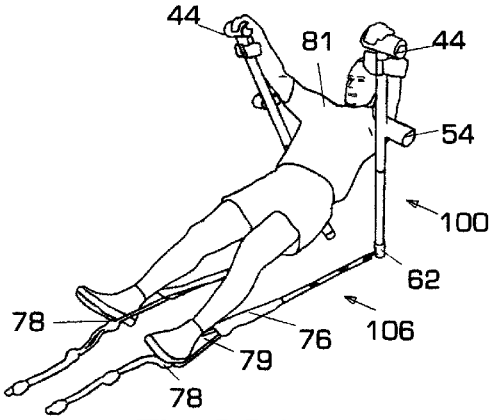
Figure 26B:
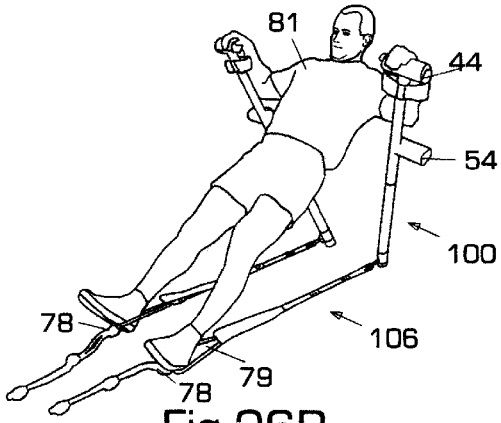
Figure 27A:
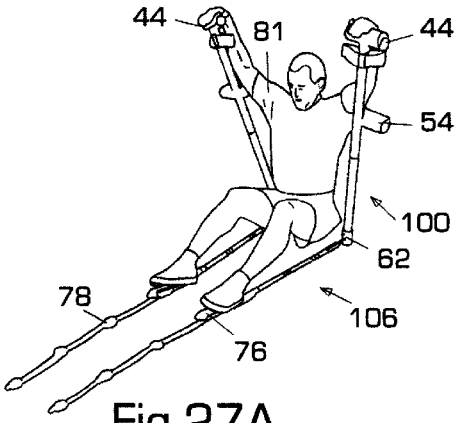
Figure 27B:
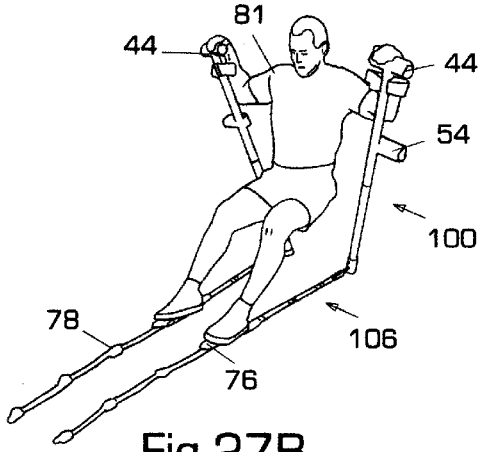
Figure 28A:
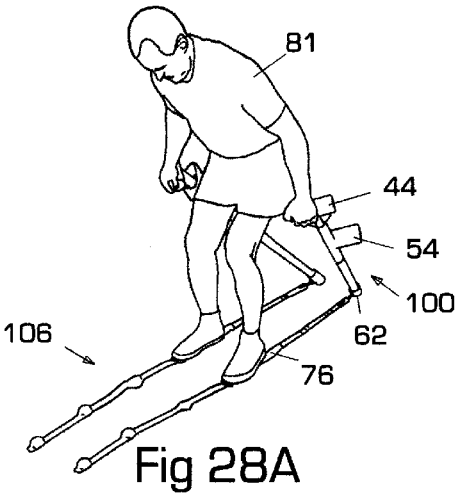
Figure 28B:
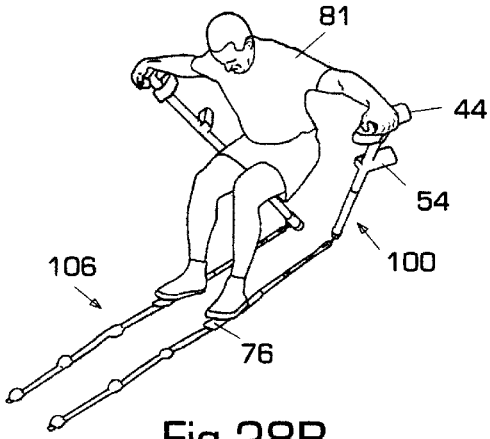
Figure 29A:
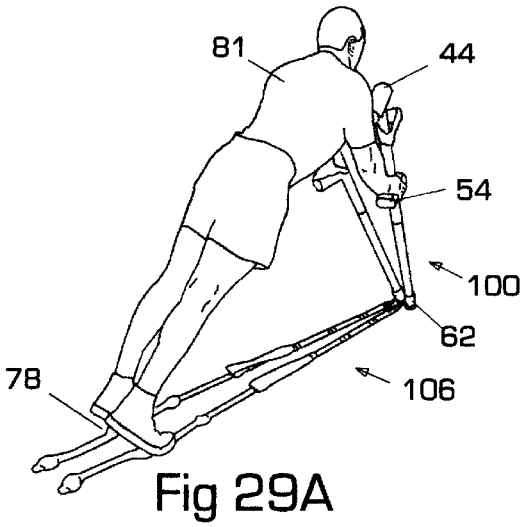
Figure 29B:
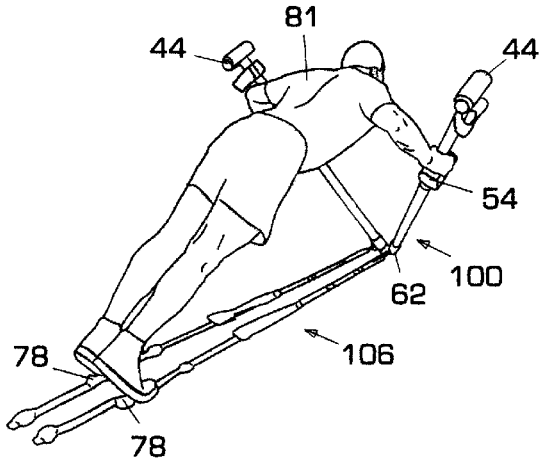
Figure 30A:
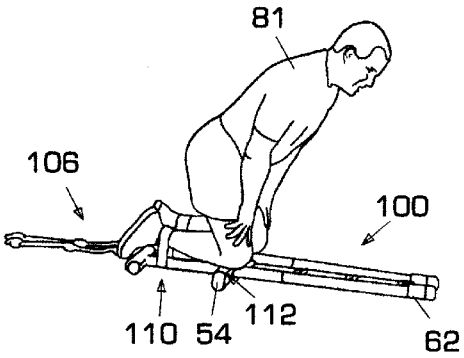
Figure 30B:
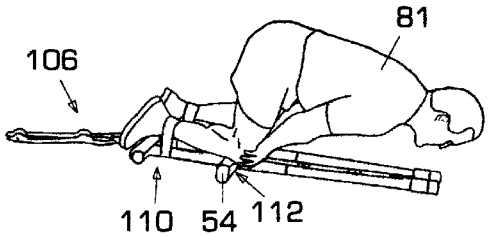
Figure 31A:
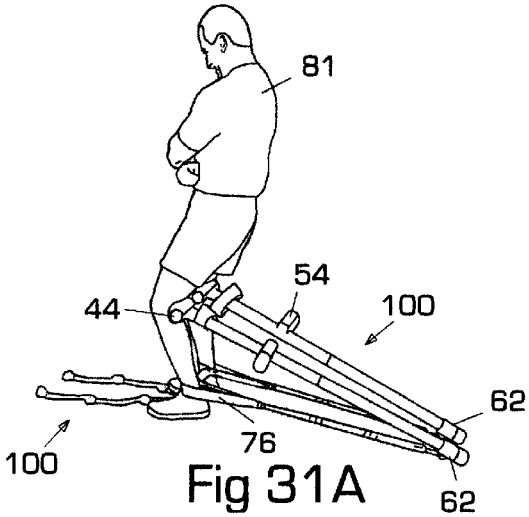
Figure 31B:
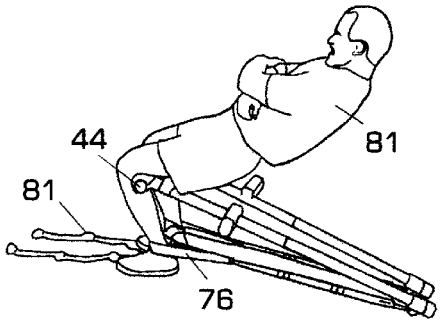

FIGS. 20A and 20B illustrate the use of the device to exercise the arm biceps muscles FIGS. 21A and 21B present a second variation for the arm biceps muscles FIGS. 22A and 22B present an exercise for the forearm muscles FIGS. 23A and 23B present an exercise for the arm triceps muscles FIGS. 24A and 24B present a second variation for arm triceps muscles FIGS. 25A and 25B present an exercise for the rear deltoids and the trapezius muscles FIGS. 26A and 26B present an exercise for the trapezius muscles FIGS. 27A and 27B present an exercise for the muscles of the upper back, namely the Latissimus dorsi FIGS. 28A and 28B present an exercise for the back, namely the outer portion of the latissimus dorsi muscles FIGS. 29A and 29B present an exercise for the pectoral muscles FIGS. 30A and 30B present an exercise for the leg biceps muscle FIGS. 31A and 31B present an exercise for the leg quadriceps muscles

DESCRIPTION OF PREFERRED EMBODIMENT

Overview (FIGS. 1,2,3,4,5)

Figure 1:
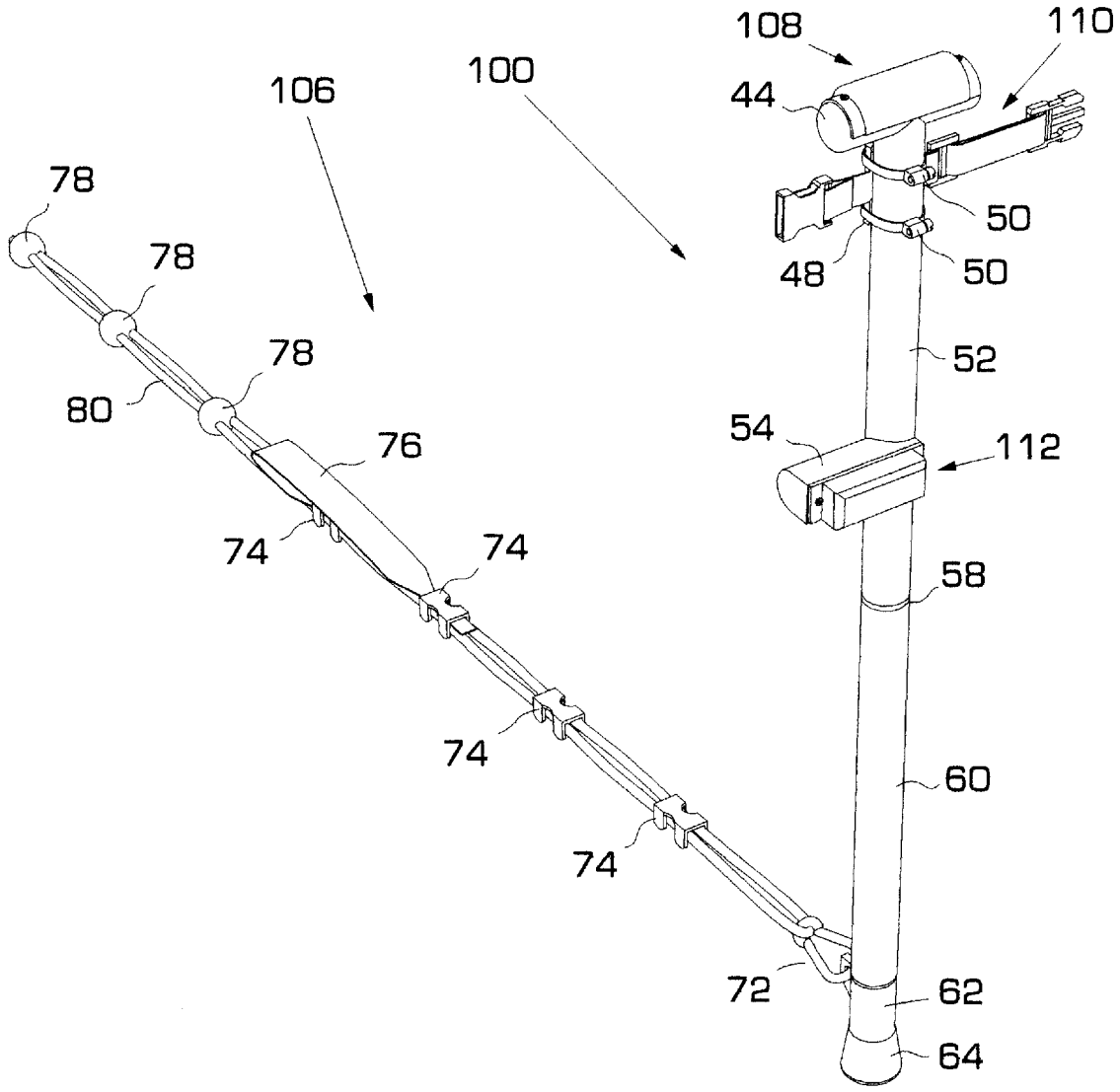

A fully assembled preferred embodiment of the proposed exerciser is shown in FIG. 1. A matching pair (not shown), which is a mirror image of that in FIG. 1, would complete the set or pair to achieve the intended functionality. In the following text, the term exerciser refers to what is shown in FIG. 1. The components are then duplicated to produce a mirror-replica.

The first component is namely a pole, or rigid-member assembly 100 with an overall length of about 130 cm. Rigid member 100 consists of a primary cushion subassembly 108, an ankle strap subassembly 110, a knee-support subassembly 112 and parts 44 through 70. Parts 66, 68 and 70 are internally located and therefore not visible in FIG. 1.

The second component is a foot restraining tether or namely a traction-member assembly 106 consisting of parts 72 through 80. The overall length of traction-member 106 is about 193 cm long or 1.5 times the length of rigid-member 100.

Figure 2:
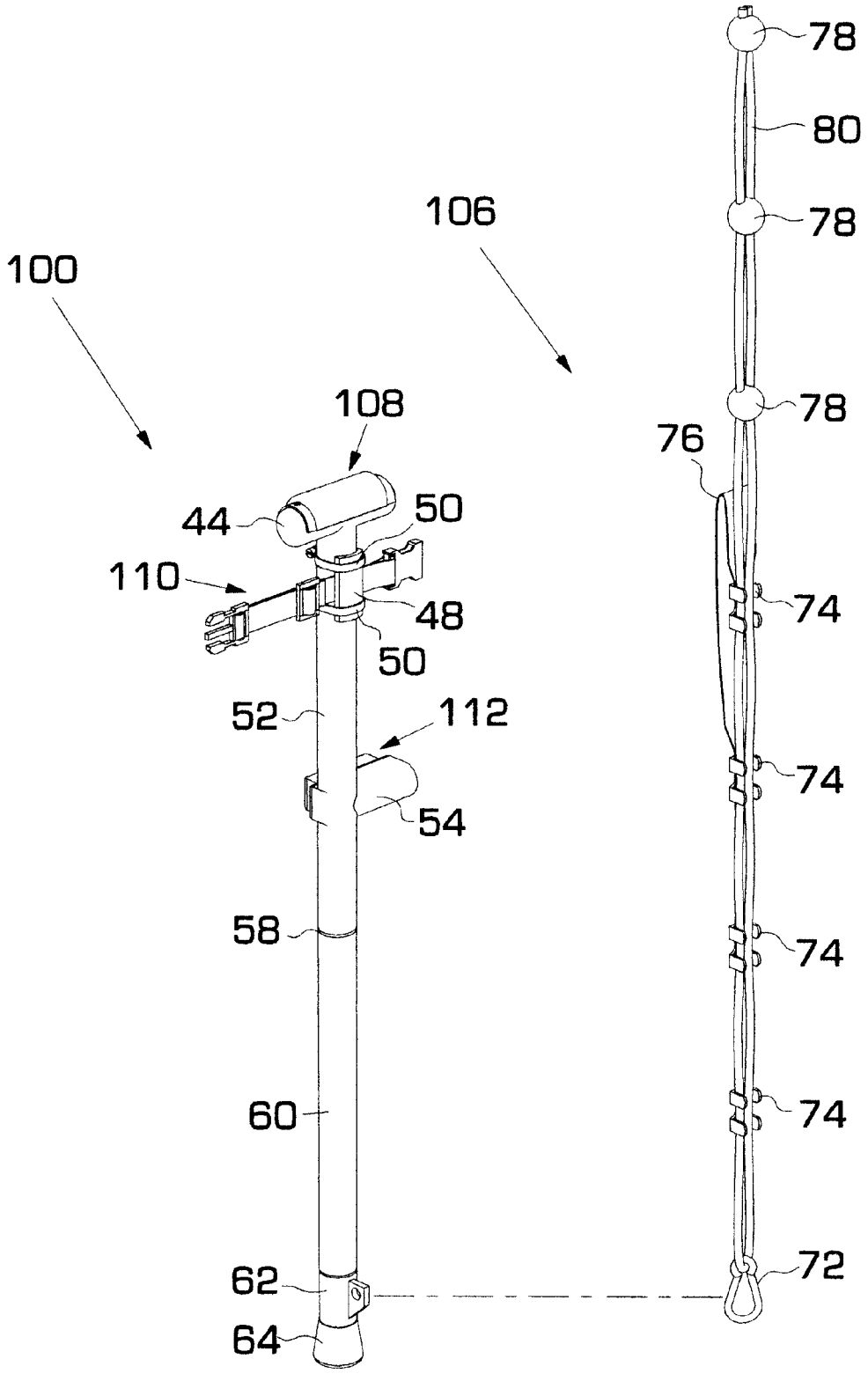

Rigid member 100 and traction member 106 are detachable from each other and this feature is illustrated in FIG. 2 from a rear-view perspective; relative to that of FIG. 1.

Figure 3:
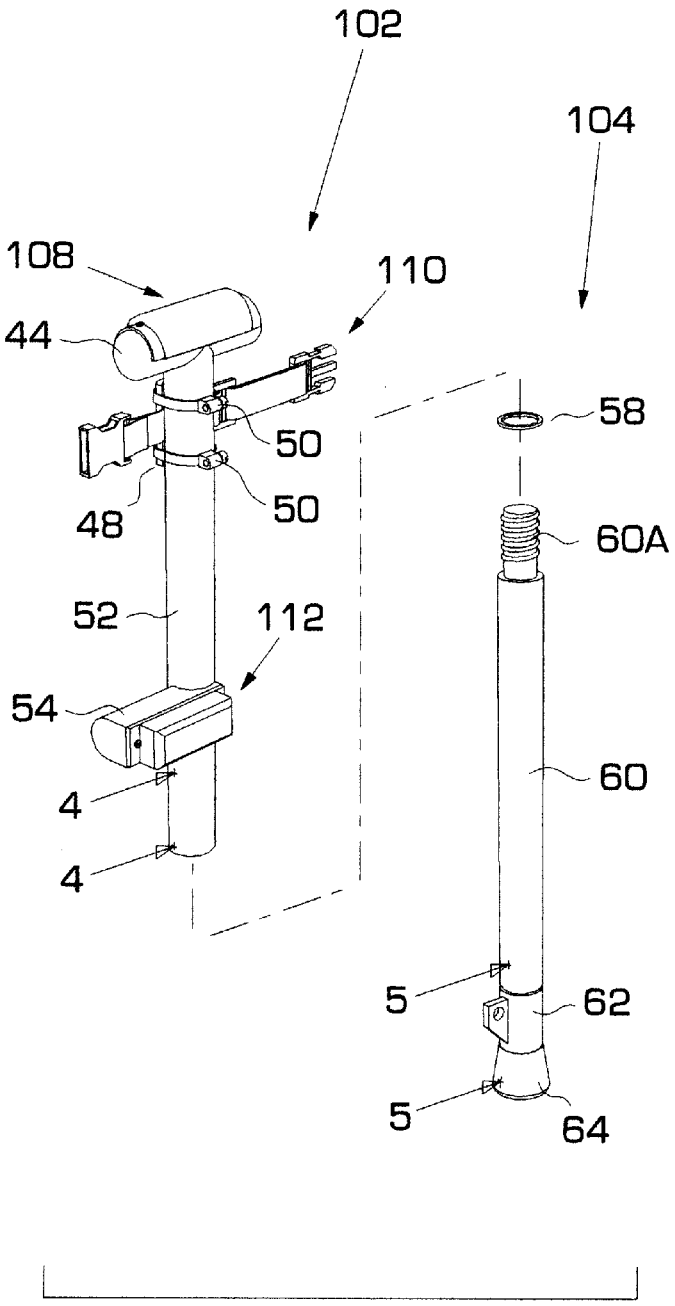

Rigid member 100 is designed to separate further in two pieces; as shown in FIG. 3. Such pieces are namely a trunk subassembly 102, and a leg subassembly 104.

Trunk 102 consists of primary cushion subassembly 108, ankle strap subassembly 110, knee-support subassembly 112, and parts 44 through 54. Cross sectional plane 4—4 at the lower end of trunk 102 reveals a threaded opening 57

Figure 4:
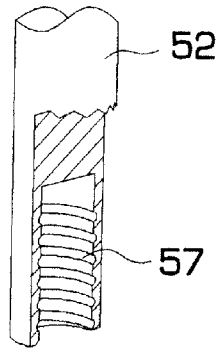

(FIG. 4). Such threaded opening 57 is meant to couple with a threaded end 59 (FIG. 3) of leg 104. Trunk 102 has an overall length of about 65 cm, which is approximately one half the overall length of rigid member 100.

Leg 104 consists of parts 58 through 70. Cross sectional plane 5—5 at the lower end of leg 104 reveals a bolt 66 (FIG. 5), a sleeve 68 and a washer 70, which are the non-visible parts of leg 104. Leg 104 has an overall length of about 65cm, which is approximately one-half the overall length of rigid member 100.

Detail—Trunk Subassembly (FIGS. 3,6,7,8,9,10)

Figure 6:
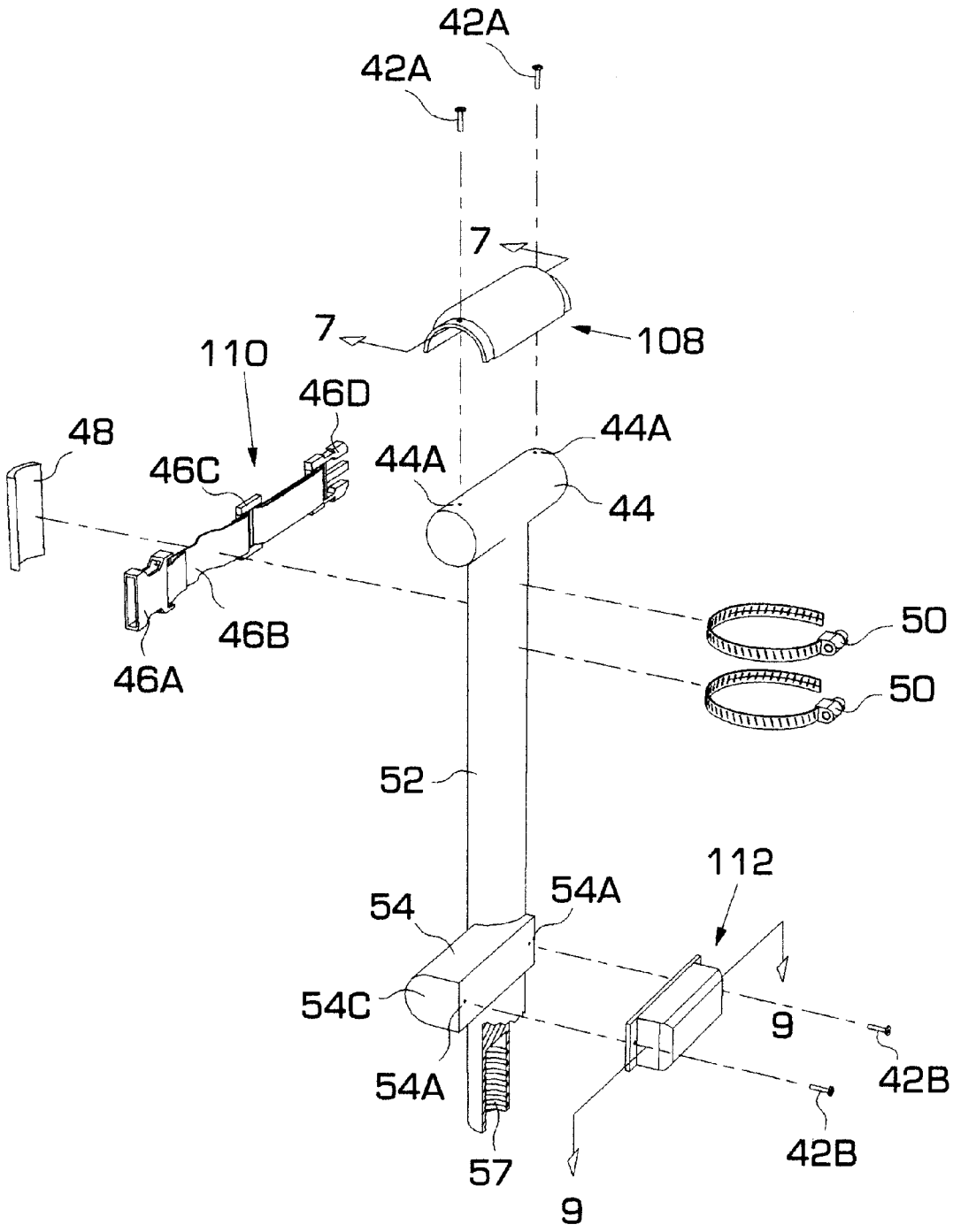
FIG. 6 is an exploded view for the trunk, or upper section of the rigid-member

FIG. 6 is an exploded view of trunk subassembly 102, displaying all the necessary parts for its assembly and their intended position. A completely assembled trunk 102 is illustrated in FIG. 3.

A main beam 52 (FIG. 6) is a solid, cylindrical part approximately 58 cm long and 4.4 cm in diameter. Beam 52 is composed of a suitable strong, lightweight polymer or metal such as polypropylene or aluminum, respectively. The bottom end of beam 52 has a threaded opening 57.

A solid, cylindrical shaped, primary handle 44 (FIG. 6) forms a welded 'T' connection at the top end of beam 52. Handle 44 is about 5 cm in diameter, 19 cm long and is composed of a suitable hard polymer or metal, similar to that of beam 52. A hole 44A is found from the top, near each end of handle 44.

An auxiliary handle 54 (FIG. 6) is located near the lower end of beam 52, a distance of about 46 cm measured from the bottom of handle 44. Handle 54 protrudes approximately 12 cm perpendicular from beam 52 and is composed of a suitable hard polymer similar to that of primary handle 44. An end face 54C has an outline resembling a closed 'U' with a curvature diameter of about 5 cm. Thus, an imaginary straight extrusion of face 54C justifies a rectangular flat surface 54B on the front side of handle 54. Surface 54B is about 5 cm wide and 15 cm long. A hole 54A is drilled near each end of surface 54B. The opposite end of face 54C is suitably shaped to match the contour of beam 52. Handle 54 is permanently attached on beam 52.

An ankle-strap subassembly 110 comprises a 5 cm wide webbing 468, a female buckle 46A, a male buckle 46D and an intermediate buckle 46C. Ankle strap 46 can be adjusted lengthwise starting from a minimum length of about 40 cm. Ankle-strap 110 (FIG. 6) is a shorter version of a common work belt found in hardware stores.

A strap-retainer 48 (FIG. 6) is a straight extrusion of a narrow, curved cross section, to a length of about 9 cm. Strap-retainer 48 is intended to secure ankle-strap 110 on beam 52.

The intended position of ankle strap 110 is at the upper end of beam 52 and below handle 44. Ankle-strap 110 is oriented with its long axis on the horizontal and it is positioned so that beam 52 is touching webbing 46B as close to buckle 46A as possible. Strap-retainer 48, is oriented with its long axis on the vertical and it is pressed firmly against webbing 46B. The length of retainer 48 exceeds the width of webbing 46B by 2 cm at each end. A pair of common "screw-adjustable metal clamps" 50 tighten each end of strap-retainer 48 on beam 52.

Figure 7:
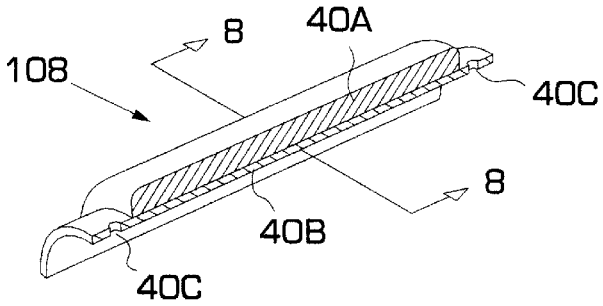
FIG. 7 is a cross sectional view illustrating the composition of the primary-cushion as indicated by section lines 7—7 of FIG. 6
Figure 8:
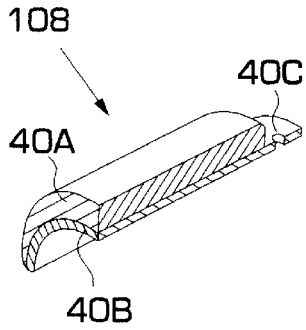
FIG. 8 is a second cross section of the primary-cushion as indicated by section lines 8-8 of FIG. 7

A primary-cushion subassembly 108 (FIG. 6) has an overall length of 18 cm and is meant to be placed on top of primary handle 44. FIG. 7 presents a cross sectional view of cushion 108, as indicated by section lines 7—7 (FIG. 6). Cushion 108 consists of a plate 40B (FIG. 7) and a layer of padding 40A. Plate 408 is curved to fit the cylindrical contour of primary handle 44 and it is made of a suitable hard plastic material such as polypropylene, polycarbonate, polystyrene and the sort. Padding 40A is made of suitable elastomer, such as polyurethane, and it is shorter in length than plate 40B, just enough to expose a hole 40C at each end. Padding 40A is permanently bonded to the upper surface of plate 40B. FIG. 8 offers a second cross section of cushion 108 to illustrate how padding 40A is layered on top of plate 40B. Primary-cushion 108 (FIG. 6) is secured on top of handle 44 by means of screws 42A that fit through holes 40C (FIG. 7) and are engaged to holes 44A (FIG. 6) of handle 44.

Figure 9:
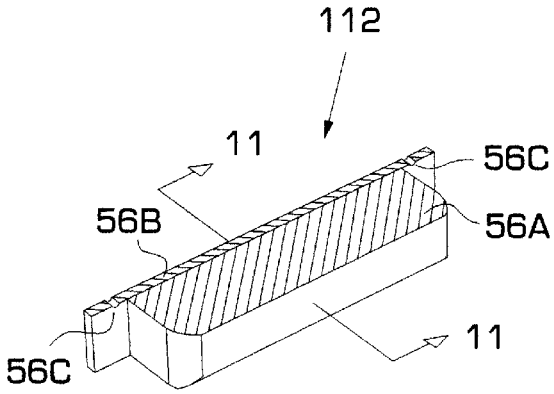
FIG. 9 is cross sectional view illustrating the composition of the knee-support as indicated by section lines 9—9 of FIG. 6
Figure 10:
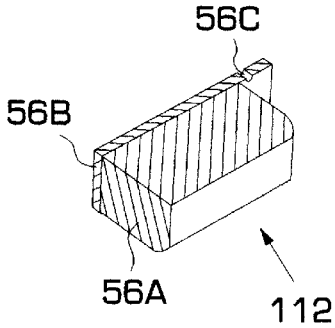
FIG. 10 is a second cross section of the knee-support as indicated by section lines 10 of FIG. 9

Similarly, a knee-support subassembly 112 (FIG. 6) is placed on the flat surface 54B of auxiliary handle 54. FIG. 9 is a cross sectional view of knee-support 112, as indicated by section lines 9—9 (FIG. 6). Knee-support 11 2 consists of a flat plate 56B (FIG. 9), intended to fit on flat surface 54E (FIG. 6) of auxiliary handle 54 and it is made of a suitable hard plastic material. A thick layer of padding 56A (FIG. 9) is made of a suitable elastomer, or soft rubber material, such as polyurethane. Padding 56A (FIG. 9) is shorter in length than plate 56B, just enough to expose a hole 56C at each end. Padding 56A is bonded to the top surface of plate 55B. FIG. 10 offers a second cross section of knee support 112 to illustrate how padding 56A is layered on top of plate 56B. Knee-support 112 (FIG. 6) is secured on auxiliary handle 54 by means of screws 42B that fit through holes 56C (FIG. 9 and are engaged to holes 54A (FIG. 6) of auxiliary handle 54.

Detail—Leg Subassembly (FIGS. 3,5,11,12)

Figure 11:
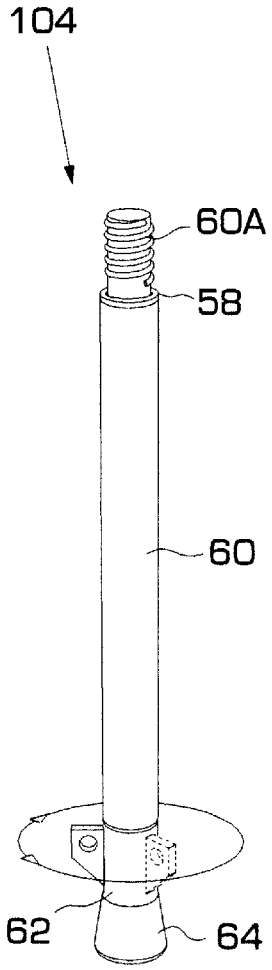
FIG. 11 illustrates how the lower end of leg subassembly can rotate freely

FIG. 12 is an exploded view showing the construction of leg subassembly 104. A completely assembled leg 104 is shown in FIG. 3 and FIG. 11.

An extension beam 60 (FIG. 12) is a solid cylindrical part about 4.4 cm in diameter and 63 cm long. Beam 60 is composed of a suitable, hard, lightweight, polymer or metal such as polypropylene or aluminum. The top end of beam 60 exhibits a threaded end 60A, which is of a slightly lesser diameter than the mid-section of beam 60. The bottom end of beam 60 (FIG. 12) forms a toe 60B of about 3.2 cm diameter and 8 cm long. At the bottom end of toe 60B there is an axial threaded opening 60C.

A revolving shoe 62 (FIG. 12) is a tubular piece about 11 cm long. Shoe 62 is composed of a suitable strong, lightweight metal or alloy. A trapezoidal lip 62C is bonded vertically, from its large edge, to shoe 62 and it contains an eyelet 62B. Shoe 62 has an inner diameter marginally larger than the outer diameter of toe 60B. A uniform round internal protrusion 62A is located; approximately 8 cm deep, near the lower end of shoe 62. Protrusion 62A is about 1 cm thick and it is intended to reduce the diameter of shoe 62. Shoe 62 is intended to fit over toe 60B with enough clearance to permit free rotation.

A sleeve 68 (FIG. 12) is a tubular piece with an outer diameter marginally smaller than that of protrusion 62A and a length marginally larger than the thickness of protrusion 62A. Sleeve 68 is intended to fit through protrusion 62A with enough clearance to allow free rotation of shoe 62. Sleeve 68 has an inner diameter similar, or slightly larger, to that of opening 60C. The upper end of sleeve 68 is intended to fit around the lip of opening 60C at the lower end of toe 60B.

A washer 70 (FIG. 12) has an inner diameter that coincides with the inner diameter of sleeve 68 and an outer diameter marginally smaller than the inner diameter of shoe 62. Washer 70 is placed at the bottom of sleeve 68, which stands in-between washer 70 and opening 60C.

A bolt 66 (FIG. 12) fits through washer 70 and sleeve 68, and engages the internal threads of opening 60C. Protrusion 62A is enclosed between washer 70 and the bottom of toe 60B. Thus, shoe 62 is prevented from falling when beam 60 is off the ground.

A friction-tip 64 (FIG. 12), similar to those commonly found on a cane or a crutch, is intended to cover the bottom end of shoe 62. Friction-tip 64 enables rigid-member 100 adhere to the ground during normal use of the exerciser.

Figure 5:
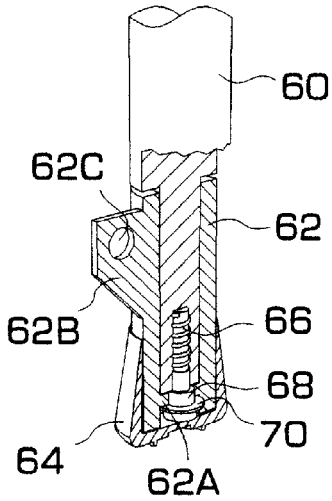

As an overview, a completely assembled shoe 62 is shown, cross-sectioned, in FIG. 5 as defined by section lines 5—5 of FIG. 3. Furthermore, the ability of the assembled shoe 62 to rotate freely on the bottom end of leg 104 is illustrated in FIG. 11.

Detail—Traction-member Subassembly (FIGS. 2,13,14,15, 16,17) A completely assembled traction-member 106 is shown from a rear view perspective in FIG. 2. An exploded view of traction-member 106 and all the necessary components for its construction is shown in FIG. 14.

The construction of traction member 106 begins with a common inelastic polyester rope 80 of about 1.2 cm diameter folded in half as shown in FIG. 13. Rope 80 forms a fold 80A at one end and a set of free ends 80B at the other end.

A set of bumps 78 (FIG. 14) is spaced at approximately 27.5 cm intervals along rope 80 so that the last of bumps 78 joins the free ends 80B of rope 80. Bumps 78 are actually double-rope knots tied on rope 80 as shown in the magnified view provided in FIG. 15. The portions of rope 80 before each bump 78 form loops 79. The resulting length of rope 80, after construction of bumps 78, is about 193 cm.

A foot-strap 76 (FIG. 14) is a piece of webbing about 5 cm wide and 51 cm long tapered at each end. Strap 76 is folded at one-third of its length and placed near the mid-section of rope 80.

A set of rope-clamps 74 spaced at regular intervals of about 27.5 cm, continues the series of bumps 78 towards folded end 80A. FIG. 16 presents a magnified view of a rope-clamp 74, which is similar to those commonly found in a hardware store. Rope clamps 74 are meant to keep together the two half-portions of folded rope 80. Two of clamps 74 have an additional function of securing webbing 76 (FIG. 14) on rope 80. A bonding material such as an epoxy type glue may be required to prevent accidental detachment of webbing 76 from its intended location on rope 80.

A spring-clasp 72 (FIG. 14), such as those commonly found in a hardware store, is placed on the folded end 80A of rope 80. Clasp 72 is intended to connect traction-member 106 to shoe 62, which serves as a branch adaptor (where elongated traction member 106 is the branch), at the bottom of rigid-member 100 as shown in FIG. 2.

The distance between the tip of spring-clasp 72 (FIG. 14) and the folded end of foot-strap 76 is about 118 cm. This distance is intended to be roughly equivalent to the overall length of rigid member 100.

Alternative Embodiments (FIGS. 18A,18B,18C,19A,19B, 19C,19D,19E)

The preferred embodiment, as described above, is complete enough to facilitate its intended function in a most cost effective, simplistic, and utilitarian manner. However, there is an unpredictable pool of variations that can be applied in nearly every aspect of the preferred embodiment. Such variations will most probably originate from a need of refinement, practicality, functionality, serviceability, manufacturing convenience, cost, durability, and so on.

Figure 18C:
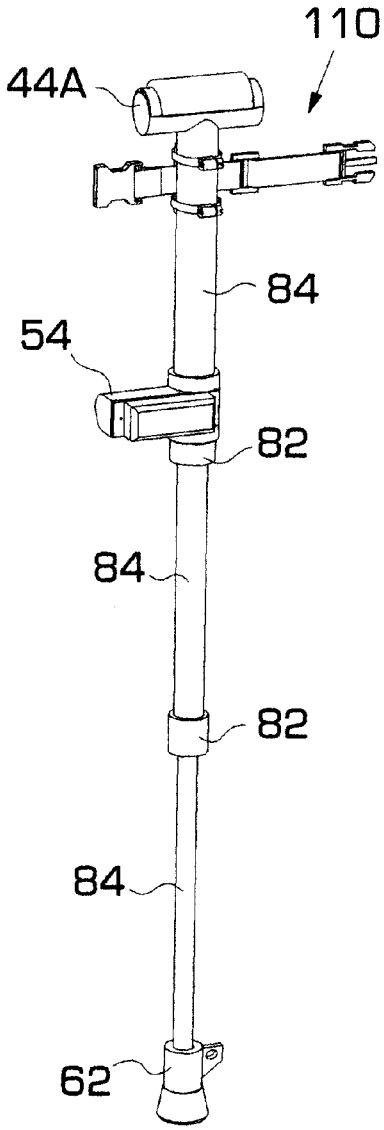

FIGS. 18A,18B,18C illustrate an alternative version of the proposed exerciser, featuring triple telescoping tubes 84 (FIG. 18C). The advantage of this design is its ability to readily reduce in size without separating in two components, as opposed to the preferred embodiment. Suitable locking mechanisms 82 (FIG. 18C) enable the tubes 84 to lock at any position, facilitating a wide range of height adjustment. Such adjustment would provide an additional method of controlling the difficulty of some exercises as well as accommodate individuals that are taller or shorter than average. In FIG. 18A the exerciser is fully reduced to roughly one-third its total length, while in FIG. 18C it is fully extended.

A primary handle 44A, an ankle-strap 110, and a knee-support 112, are parts closely equivalent to those described for the preferred embodiment. An auxiliary handle 54A is modified from the preferred embodiment to be adjustable on the body of the alternative exerciser as shown in FIG. 18B.

The device of FIGS. 19A,19B,19C is a good example of a seemingly drastic mutation. FIGS. 19A and 19B present a folding-type exerciser in a semi-folded and a fully extended position respectively. The body of the exerciser is no longer cylindrical as in FIGS. 18A, 18B, 18C, but instead it is wide and flat (or curved). A wide surface 90 (FIG. 19B) is deliberately allocated between openings 88. Surface 90 is intended so that a person can comfortably rest their entire weight on his/her knees without distress.

A pivoting linkage 92 (FIG. 19B) provides the necessary folding functionality. There is also provision for a suitable locking mechanism (not shown) near linkage 92. Such mechanism prevents the device from folding accidentally during normal use.

A cylindrical handle 86 (FIG. 19B) is the equivalent of primary handle 44A (FIG. 18A). Numerous auxiliary handles 88 (FIG. 19B) eliminate the need of handle adjustment all together. Auxiliary handles 88 in FIG. 19B are, in fact, convenient openings, holes or windows on the body of the device. A bottom ledge 88A on each of those openings serves as a handle, during normal use.

A retractable belt 93 (FIG. 19B) is provided to replace traction member 106 (FIG. 14). Such retractable belt 93 is a lot similar to a seat belt commonly found in the automotive industry. Belt 93 slides through a "pivoting, belt slot" 99 similar to the ones mounted on the side pillars of most passenger cars. A retracting-cartridge 98 for such belt 93 is located near (or is part of) pivoting-linkage 92. Cartridge 93 has a "lock-and-release" mechanism (not shown) to control the length of belt 93. Controls (not shown) for accessing the lock-and-release mechanism of cartridge 93 can be suitably situated anywhere on the body of the exerciser.

A retractable belt 93 would nullify most of the accessories found previously on the traction-member assembly 106 (FIG. 14). There is no longer a need for bumps 78 (FIG. 14) distributed at regular intervals. The same effect can be achieved by merely adjusting the length of belt 93 (FIG. 19B) so that a bump 94 is at the desired location.

A foot-strap 96 (FIG. 19B) serves the equivalent purpose of foot-strap 76 (FIG. 14). Furthermore, when foot-strap 96 is bent around primary handle 86, as shown in FIG. 19C, then it can serve the same function as that of ankle-strap 110 (FIG. 18). Thus, a strap 110 as shown in FIG. 18A is not needed for the exerciser shown in FIG. 19C.

FIGS. 19D and 19E illustrate a further simplified arrangement of retractable belt 93, which nullifies the need for a bump 94 (FIG. 19B) and a foot-strap 96. Belt 93 (FIGS. 19D,19E) feeds from cartridge 98, slides through belt slot 99A and is fixated on belt slot 99. The section of belt 93 between belt slots 99 and 99A can be extended to form a loop as shown in FIG. 19E.

Any alternative embodiment, regardless of its degree of mutation, would be operated to perform exercises in the same way to that of the preferred embodiment. In other words, understanding of how to operate the preferred embodiment, will extend to the alternative embodiments as well.

Operation of the Preferred Embodiment

Overview

The operator starts by selectively positioning his/her body to interface with the device, holding on to rigid-members 100, and securing the feet on traction-members 106, as exemlpified in FIG. 20A. The operator proceeds by inducing repetitive displacement of his/her own bodyweight through motion of the arms (or legs, depending on the exercise to impart fatigue on the working muscles.

The function of traction-members 106 (FIG. 20A) is to restrain the operator's feet relative to each of rigid-members 100. The importance of traction-members 106 becomes apparent in several exercises, where the operator's body is positioned at such a shallow angle (see FIG. 21A,21B), that it would be impossible to keep rigid-members 100 and the operator from loosing traction and skidding apart.

Ankle strap 110 can be adjusted on beam 52 by loosening metal clamps 50, lowering ankle-strap 110 and retightening metal clamps 50 at a new position on beam 52. Such adjustment may be necessary for some individuals to ensure that ankle strap 110 is at a proper distance from knee-strap 112. This adjustment would facilitate comfortable execution of the leg curl exercise shown in FIGS. 30A,30B.

The philosophy of using the proposed exercise device is similar to that of doing common push-ups. In the case of push-ups, the operator assumes a position above the ground and takes advantage of gravity to resist the motion of his/her arms. Similarly, the operator can use the proposed device to make gravity resist the motion of his/her arms (or legs) in ways that would isolate a specific muscle group, or combinations of muscle groups.

The exercise method (FIGS. 20A through 31B)

The proposed device can be utilized to isolate and exercise a wide range of muscles throughout the body. A list of postures has been developed for that purpose and an indicative set of such postures is presented in FIGS. 20A through 31B. However, there is a great number of variations and minor adjustments that can be performed which can not be practically shown in this text. Furthermore, the end user will be encouraged and challenged to develop intuition for his/her own body by discovering the proper posture and variations that optimize the intended effect of each exercise.

In the following text, the initial and final positions of each exercise are indicated by a letter suffix following each figure number. For example, FIG. 20A indicates the initial position, while FIG. 20B indicates the final position of the same exercise. For every exercise shown in FIGS. 20A through 31B there is a corresponding equivalent, which can be performed in a commercial weight-training facility.

Exercises for the arms

FIGS. 20A,20B illustrate a posture intended to isolate the arm biceps muscle group. The rigid-members 100 are spaced apart to shoulder-width and they are arranged parallel to each other. The traction members 106 are placed on the ground, extended straight, and parallel to each other. At the initial stage (FIG. 20A), the operator 81 is facing up, holding primary handles 44 and keeping rigid members 100 slightly tilted from vertical and above the shoulders. The operator's knees are bent and his/her feet are positioned near the end of foot-straps 76. At the final stage (FIG. 20B), the operator bends the elbows flexing the biceps muscles, thus pulling the entire body upwards while keeping rigid members 100 as still as possible. This exercise is equivalent to a common 'Concentration curl'.

FIGS. 21A,21B illustrate a variation exercise for the arm biceps muscle group. The rigid-members 100 of the exerciser are arranged to converge to a point at the bottom end, while they are kept spaced at shoulder-width near handles 44. The traction members are extended on the ground parallel to each other. At the initial stage (FIG. 21A), the operator 81 is nearly laying horizontal, without touching the ground, facing upwards. The operator 81 is holding handles 44 with elbows slightly bend and close to the torso. The toes of the operator's feet are pressing against the first row of bumps 78 of the traction members 106. The rigid-members 100 are positioned over the operator's shoulders with auxiliary handles 54 facing outwards. The operator's hips are resting on his/her heels. At the final stage (FIG. 21B) the operator bends his/her elbows pulling towards handles 44 pivoting the entire body about bump 78. This exercise is equivalent to a common 'Barbell curl'.

FIGS. 22A,22B illustrate a posture intended to isolate the forearm muscles. The rigid members 100 are held parallel to each other at a very shallow angle so that handles 44 are at knee-height. The traction-members 106 are extended parallel, placed on the ground. At the initial stage (FIG. 22A) the operator 81 positions his/her toes behind the first row of bumps 78 and rests the posterior of the forearms on the knees. The operator 81 leans slightly forward pushing with the knees against the wrists while holding handles 44 at the base of his/her fingers bending the wrists and creating tension on the flexor muscles of the forearms. At the final stage (FIG. 22B) the operator 81 uses wrist motion to push against handles 44. This exercise is equivalent to a common 'Wrist-curl'.

FIGS. 23A,23B illustrates a posture intended to isolate the arm triceps muscle group. The rigid members 100 are arranged to converge to a point at the lower end, forming a v-shape, which is hip-wide near auxiliary handles 54. The traction-members of the exerciser are extended parallel to each other and lay on the ground. At the initial stage (FIG. 23A), the operator 81 is in a bent position facing towards the ends of traction-members 106, with the arms extended downwards, in line with the torso, holding handles 54. The operator's feet are positioned on top of foot-straps 76. At the final stage (FIG. 23B) the operator bends his/her elbows in a strict motion lowering his/her entire body pivoting around the ankles. This exercise is equivalent to a common 'Cable triceps pull-down'.

FIGS. 24A,24B illustrate a variation posture intended to isolate the arm triceps muscle group. The rigid-members 100 are arranged to form a v-shape converging to a point at the ends while auxiliary handles 54 are pointing inwards and touching each other. The traction members 106 are extended, laying on the ground parallel to each other. At the initial stage (FIG. 24A) the operator 81 is facing downwards with his/her extended holding handles 54. The operator's toes are pressed against the second row of bumps 78 on traction-members 106 and the knees are slightly bent. At the final stage (FIG. 24B), the operator leans forward bending his/her elbows to bring handles 54 near the forehead. This exercise is equivalent to 'Lying triceps extensions' with a bar.

Exercises for deltoids and muscles at the shoulders

FIGS. 25A,25B illustrates a posture intended to isolate the rear deltoid and upper trapezius muscles. The rigid members 100 are arranged to form a v-shape, either converging at the ends with handles 44 spaced apart, or converging at the top with shoes 62 spaced apart. At the initial stage (FIG. 25A) the operator 81 is holding handles 44 with arms extended along the direction of the rigid-members 100. The operator 81 secures the insets of his/her feet through the loops 79 against the first row of bumps 78, while at a sitting position, resting the hips on the heels of his/her feet. At the final stage (FIG. 25B) the operator pulls his/her torso forward bringing handles 44 at shoulder height. This exercise is equivalent to 'Upright-rows', especially when performed with the shoes 62 spaced apart.

Exercises for the upper and lower back

FIGS. 26A,26B illustrates a posture intended to isolate the upper back and trapezius muscles. The lower ends of rigid-members 100 are spaced apart at shoulder-width and held nearly vertical, while handles 54 are pointing outwards. The traction members 106 are extended parallel to each other. At the initial stage (FIG. 26A), the operator's body is tilted to a shallow angle facing upwards with arms extending forward and holding handles 44. The operator's heels are secured within loops 79 against the first row of bumps 78. At the final stage (FIG. 26B) the operator pulls his/her entire body upwards pivoting about his/her heels to bring the chest near the level of handles 44. This exercise is equivalent to a 'Lateral prone raise', or 'Wide grip rows'.

FIGS. 27A,27B illustrates a posture intended to isolate the latissimus dorsi muscles of the back. The rigid-members 100 are spaced at shoulder-width and held nearly vertical, with handles 54 facing outwards. The traction members 106 are extended on the ground parallel to each other. At the initial stage (FIG. 27A) the operator's torso is on the vertical and in-between rigid members 100. The operator's legs are extended forward with the knees slightly bent and the feet pressing on foot-straps 76. At the final stage (FIG. 27B) the operator pulls upwards bringing the shoulders at the level of handles 44. This exercise is equivalent to a 'Lat pulldown' or a 'Chin-up'.

FIGS. 28A,28B illustrate a posture intended to isolate the outer latissimus dorsi muscles. The rigid members 100 are spaced apart at shoulder-width and handles 54 are facing outwards. The traction-members 106 are extended on the ground parallel to each other. At the initial stage (FIG. 28A) the operator 81 stands on foot-straps 76 with his/her torso slightly bent forward. The operator's arms are held close to the body holding handles 44. Rigid-members 100 extend backwards tilted to the same angle as the operator's torso. At the final stage (FIG. 28B) the operator opens his/her arms laterally in a strict controlled movement, lowering his/her body pivoting about the feet. The resulting posture should resemble a gymnastic 'L-cross' stunt. This exercise is equivalent to 'Vertical cable flyes'.

Exercises for the pectoral muscles

FIGS. 29A,29B illustrate a posture intended to isolate the pectoral muscle group. The rigid-members 100 are arranged to form a v-shape, converging to a point at the lower end. The traction-members 106 are extended on the ground and are also converging to the same point as rigid-members 100. At the initial stage (FIG. 29B) the operator's body is kept straight and tilted forward with arms extended to the front holding handles 54. The operator's toes are pressed against the second row of bumps 78 on traction-member 106. At the final stage (FIG. 29B) the operator extents his/her arms sideways as it would be in a hugging movement, lowering their torso bringing the chest at the level of handles 54. This exercise is equivalent to 'Bench flyes'.

The equivalents of decline and incline 'Bench flyes' can also be accomplished, depending on the position of the operator's feet on traction-member 106 and the orientation of the torso relative to rigid members 100.

Exercises for the legs

FIGS. 30A,30B illustrate a posture intended to isolate the leg biceps muscles. The rigid-members 100 are positioned flat on the ground, parallel to each other, with handles 54 facing outwards. The traction members 106 are not utilized in this exercise, thus they are aesthetically positioned in between rigid-members 100. At the initial stage (FIG. 30A) the operator 81 kneels on top of rigid-members 100. The operator's ankles are strapped with ankle-strap 110 and the operator's knees are cushioned by knee-supports 112. The operator bends his/her torso slightly forward in order to bring the center of gravity just in front of his/her knees. At the final stage (FIG. 30B) the operator pivots about his/her knees on supports 112 leaning forward until the operator's head is close to, but not touching, the ground. This exercise is equivalent to a 'Leg curl'.

FIGS. 31A,31B illustrate a posture intended to isolate the leg quadriceps muscles. The rigid members 100 are arranged parallel to each other with handles 54 facing outwards. At the initial stage (FIG. 31A) the operator 81 places foot-straps 76 around the angles and primary handles 44 at the crook of his/her knees. The operator 81 is standing cross-armed with his/her knees slightly bent. At the final stage (FIG. 31B) the operator 81 lowers his/her entire body backwards in a strict controlled motion, pivoting about his/her knees, until the torso becomes almost horizontal. This exercise is equivalent to a 'Leg extension'.

Within each exercise mentioned above, there is a great number of sub-variations that can be performed to uniquely involve minor muscles as well as different portions of major muscles. Furthermore, the difficulty of each exercise can be adjusted depending on how the operator chooses to locate the center of gravity of his/her own bodyweight.

Conclusions Ramifications and Scope

Simplicity, utilitarian design, lightweight structure, travel size, extensive function, freedom of motion, weight resistance and muscle building, are some indicative keywords that can be used to describe the proposed exerciser. It has been developed and succinctly designed to exhibit the most favorable features of a workout experience in a commercial facility. At the same time it intents to fulfill any desire for mobility without sacrificing thoroughness and effectiveness. Furthermore, by virtue of its simplicity the proposed device is also cost effective. With such an extensive array of exercise variations at such a compact package, this device offers enough functionality so that the only thing which needs to be supplied, is the determination and dedication of the individual towards health and fitness.

The preferred embodiment as mentioned in this text is capable of performing the intended functions without signs of deficiency. However, as mentioned before, there is a number of factors that may necessitate mutations of the device. Such mutations can be drastic, as it was briefly illustrated by the alternative embodiments presented earlier in this text, or they can be relatively minor. Regardless of how extensive, or numerous, the potential changes may be, the principal characteristics, or essence, of the design should remain constant.

Therefore, in essence, the proposed device is an arrangement of a pole connected to line (tether) and used in pairs with the intent to perform weight resistance exercises. Within this design boundary, a number of refinements can be applied to maximize functionality.

In the preferred embodiment, the pole is represented by rigid member 100 (FIG. 1) and the line is represented by traction member 106.

The rigid member 100 can be fixed, reducible, continuously variable or intermittently variable in length and its material composition can vary, as long as its weight is minimal and it can withstand any compressive and bending forces generated during normal operation.

The rigid member 100 comprises:

a) A primary handle 44 located above the middle, and preferably, at the upper end of rigid member 100. Primary handle 44 may come in a variety of shapes or materials, as long as it is comfortable both to the hands and when pressed against the crook of the knee and it can withstand pressure along the axis of rigid member 100. Primary handle 44 may be fixed, it may be adjustable in height, it may be detachable, it may be pivoting, it may be slidable, and it may have optional attachments such as a cushion 108.

b) An optional auxiliary handle 54 (FIG. 1) (or a plurality of auxiliary handles) distributed anywhere along the body of rigid member 100. Auxiliary handle(s) 54 may come in a variety of shapes, or materials, as long as it can accept downward pressure along the axis of rigid member 100, exerted by the hands of the operator. Auxiliary handle(s) 54 may be permanent, adjustable, detachable, sliding, pivoting, and it may have optional attachments such as a knee-support 112.

c) A knee-support 112 (FIG. 1) located near the middle of rigid member 100. Knee-support 112 may come in a variety of shapes and materials, as long as it feels comfortable to an average human being when supporting his/her entire weight. Knee support 112 may be adjustable, detachable, or fixed on rigid member 100. Knee support 112 may also exist as an attachment for auxiliary handle 54 or it can be blended as part of the design of rigid member 100.

d) An optional ankle-strap 110 (FIG. 1) adjustably or permanently located preferably near either end of rigid member 100. The distance between ankle strap 110 and knee support 112 should be equivalent to that from the ankle to the knee of an average person. Ankle strap 110 may be adjustable or fixed in length, it may be detachable or permanent, it may be flexible or rigid. The material composition and shape can vary, as long as it can firmly retain a person's ankle on rigid member 100 without inducing discomfort. The use of ankle strap 110 is shown in FIGS. 30A and 30B.

e) A juncture element such as shoe 62 (FIG. 1), or belt-slot 99 (FIG. 18B), preferably near the lower end of rigid member 100. Such juncture element may have revolving or pivotal characteristics and its shape can vary as long as it can sustain tensional forces generated on traction member 106 and allows rigid member 100 to rotate about its axis, to a certain extent, without restriction from traction member 106.

f) A friction-tip 64 at the lower end of rigid member 100 can assume a variety of shapes and material compositions as long as it provides stable ground engagement and it doesn't restrain the swaying motion of rigid member 100 in any direction.

g) Optional attachments such as a belt cartridge 98 (FIG. 19B can be located any-where on the body of rigid member 100.

The traction member 106 is preferably 1.5 times, or longer, than a fully extended rigid member 100 and it can be fixed or adjustable in length, continuously extendable or intermittently extendable and comprising any of:

a) Optional bump 94 (FIG. 19B) or bumps 78 (FIG. 1) spaced apart and arranged longitudinally towards the free end of traction member 106. The shape and material composition of bump 94, or bumps 78, can vary as long as it provides unfailing foot support during normal exercise. Bump 94 (or bumps 78) may have optional attachments such as a foot-strap 96 as shown in FIG. 19B.

b) optional loop formations such as loops 79 (FIG. 14) or foot-strap 76 (FIG. 19B), distributed along the length of traction member 106.

There should be at least one obstruction, either a bump or a loop, found directly bellow primary handle 44 when rigid member 100 is tilted over traction member 106 and primary handle 44 is at knee's height, thus facilitating a leg extension exercise as shown in FIGS. 31A and 31B.

I claim:

1. A training device to perform weight resistance muscle building exercises comparable to curls, pull downs, rows, flyes and extensions, and said device comprises:

an elongated rigid member having a length, a top end, a bottom end, a handle grip attached to said top end, a rigid knee support adjustably attached midways on said rigid member for use by a human to kneel on said support when said rigid member lays horizontal on a surface, a ground engaging tip attached to said bottom end to permit full three dimensional freedom of motion of said handle grip radially about said tip, a coupling eyelet attached proximally to said bottom end in the vicinity of said tip, and a flexible inelastic elongated traction member to serve as a floor resident foot restraining tether, having a first end, a flexible main body, and a second end, and having a plurality of foot restraining bumps attached starting at said first end and distributed along said flexible main body towards said second end to permit selectable static engagement of a human's foot relative to a ground surface, and having a coupling clasp attached to said second end for connection of said traction member to said coupling eyelet of said rigid member.

2. The training device of claim 1 further comprising:

a second elongated rigid member having a length, a top end, a bottom end, a handle grip attached to said top end, a rigid knee support adjustably attached midways on said rigid member for use by a human to kneel on said support when said rigid member lays horizontal on a surface, a ground engaging tip attached to said bottom end to permit full three dimensional freedom of motion of said handle grip radially about said tip, a coupling eyelet attached proximally to said bottom end in the vicinity of said tip, and a second flexible inelastic elongated traction member to serve as a floor resident foot restraining tether, having a first end, a flexible main body, and a second end, and having a plurality of foot restraining bumps attached starting at said first end and distributed along said flexible main body towards said second end to permit selectable static engagement of a human's foot relative to a ground surface, and having a coupling clasp attached to said second end for connection of said traction member to said coupling eyelet of said rigid member.

3. The training device of claim 1 further comprising an angle strap adjustably attached proximally to said top end of said rigid member for use in conjunction with said rigid knee support to permit execution of leg curl exercises.

4. The training device of claim 1 wherein said rigid knee support is a protrusion at right angles to said rigid member further suited for use as a secondary handle grip.

5. The training device of claim 1 wherein said coupling eyelet further comprises revolving means to permit said eyelet to orbit freely around said bottom end of said rigid member.

6. The training device of claim 1 wherein one of said foot restraining bumps has a distance to said second end of said traction member and said distance is substantially equal to said length of said rigid member for use of said bump in conjunction with said handle grip to permit execution or leg extension exercises.

* * * * *